United States Patent [19]

Artzberger

[11] Patent Number: 4,895,478

[45] Date of Patent: Jan. 23, 1990

[54] ADJUSTABLE HANDLE CONSTRUCTION FOR A COMPACTION APPARATUS

[75] Inventor: Thomas G. Artzberger, Menomonee Falls, Wis.

[73] Assignee: M-B-W Inc., Slinger, Wis.

[21] Appl. No.: 234,889

[22] Filed: Aug. 22, 1988

[51] Int. Cl.[4] ..... E01C 19/34

[52] U.S. Cl. ..... 404/133; 404/113

[58] Field of Search ..... 404/113, 133; 16/112; 173/170, 168, 162.2; 248/609

[56] References Cited

U.S. PATENT DOCUMENTS

| | | | |
|---|---|---|---|
| 3,236,164 | 5/1961 | Miller | 404/133 |
| 3,453,940 | 7/1969 | Berkhoudt | 404/133 |
| 3,934,537 | 1/1976 | Hall | 248/609 |
| 4,014,620 | 3/1977 | Vural | 404/133 |
| 4,685,531 | 8/1987 | Kopich | 248/609 |

FOREIGN PATENT DOCUMENTS

| | | | |
|---|---|---|---|
| 286127 | 12/1963 | Australia | 404/133 |
| 7811052 | 5/1979 | Netherlands | 404/133 |
| 321787 | 7/1957 | Switzerland | 404/133 |

*Primary Examiner*—Jerome W. Massie, IV
*Assistant Examiner*—Gay Spahn
*Attorney, Agent, or Firm*—Andrus, Sceales, Starke & Sawall

[57] ABSTRACT

An adjuster handle construction for a soil compactor such as a percussion rammer. The compactor includes a shoe adapted to engage the surface to be compacted and the shoe is driven in a reciprocating path by a drive cylinder which, in turn, is operated by an engine located at the upper end of the compactor. A tubular guard surrounds the engine and engine components, and a handle is pivotally connected to the guard. The handle can be locked to the guard through an adjustable locking mechanism, so that the handle can be positioned in a plurality of different elevations.

3 Claims, 1 Drawing Sheet

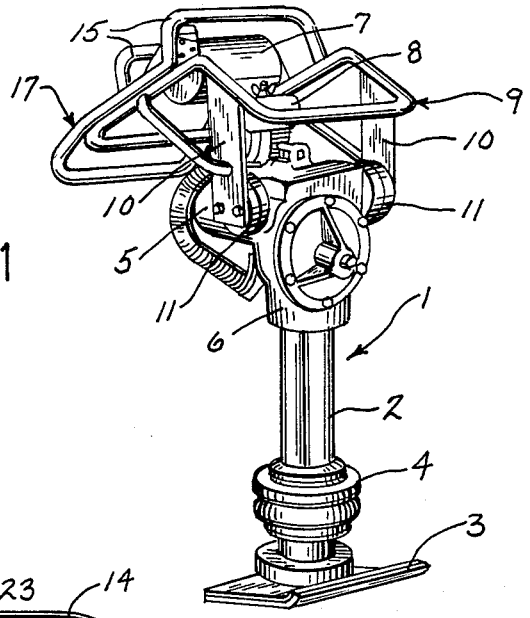
FIG. 1
FIG. 2
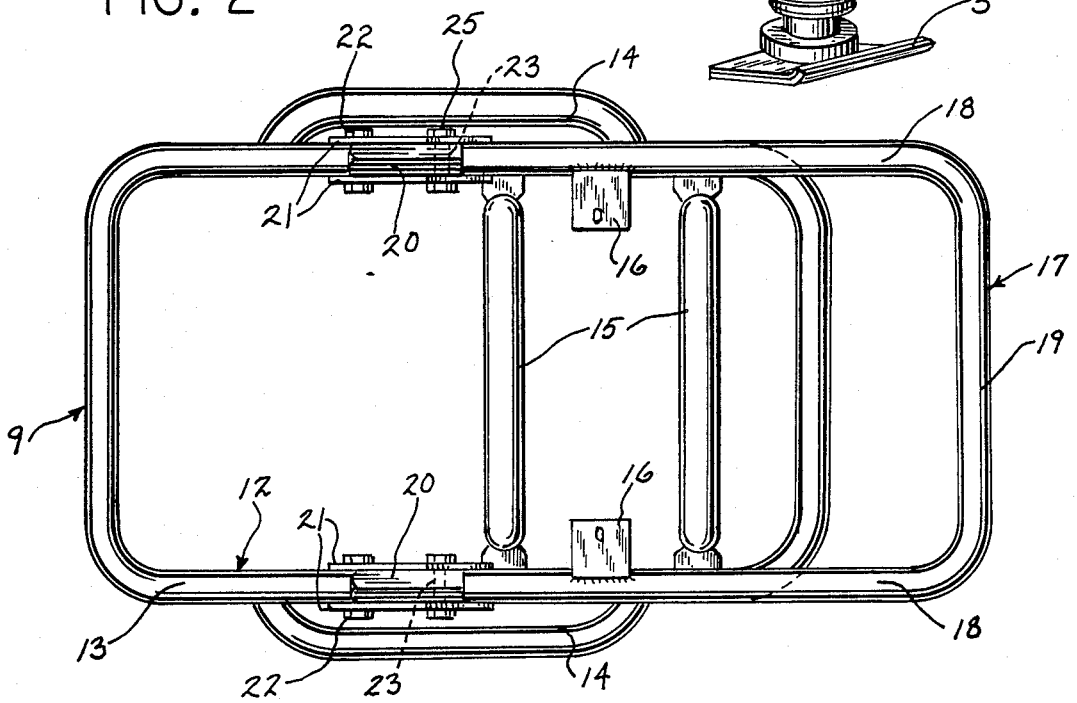
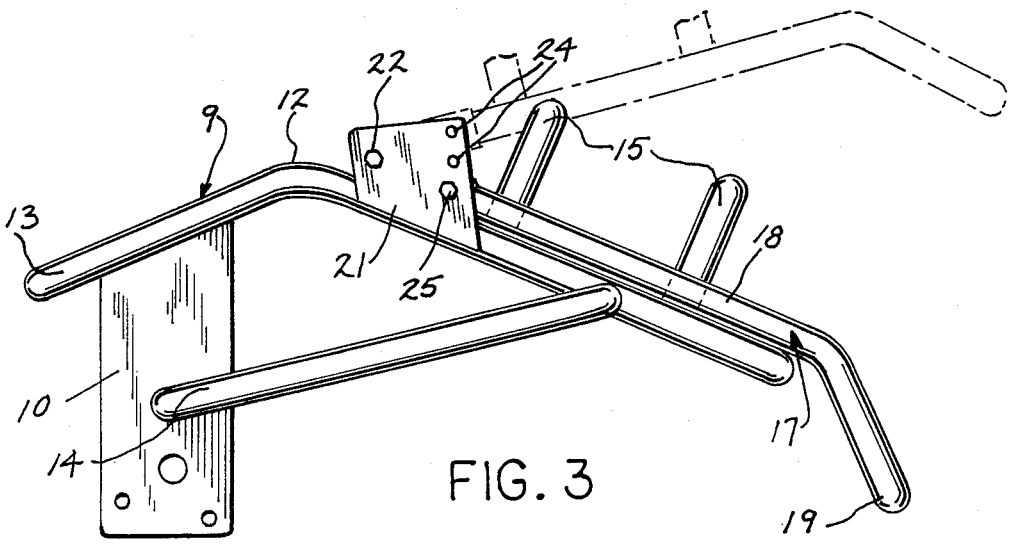
FIG. 3

ADJUSTABLE HANDLE CONSTRUCTION FOR A COMPACTION APPARATUS

BACKGROUND OF THE INVENTION

Percussion rammers are used in the construction industry for soil compaction. A percussion rammer differs from a vibratory compactor in that the percussion rammer operates at a relatively slow speed, in the neighborhood of about 600 strokes per minute, with a stroke in the range of 2 to 3 inches, as compared with the vibratory compactor which operates at a faster speed of about 4,000 strokes per minute and with a small stroke in the neighborhood of about 1/16th inch. The percussion rammer tends to pound the ground, as opposed to vibrating the ground, and is frequently used on clay or other heavy soils.

A percussion rammer is frequently employed to compact soil in narrow trenches, such as those used in laying electrical or gas lines. If the trench has a substantial depth, the operator's handle of the rammer may be located close to the ground level at an awkward and uncomfortable position for the operator. For example, if the trench has a depth of 12 inches, the handle would only be located about 18 inches above the ground making it very difficult for the operator to control the rammer.

SUMMARY OF THE INVENTION

The invention is directed to an adjustable handle construction for a compacter and has particular use with a percussion rammer. The percussion rammer itself is of conventional construction, including a vertical drive cylinder having a piston rod connected to a shoe that is adapted to engage the soil to be compacted. A gas engine located at the upper end of the rammer is operably connected through a transmission to drive the piston and thereby move the shoe in a reciprocating stroke against the soil.

A tubular guard surrounds the upper portion of the rammer protecting the engine, the gas tank and other engine components.

In accordance with the invention, a handle is pivotally connected to the guard and extends to the rear of the rammer. An adjustable locking mechanism is associated with the handle to enable the handle to be locked in various elevations.

When using the compactor on level terrain the handle would normally be locked in a lower position which would be similar to a standard handle position. When operating in a trench or at a lower elevation, the handle can be pivoted upwardly and locked at an inclined elevation, thereby enabling the handle to be in a relatively standard position even though the rammer is operating beneath grade in a trench or at a lower elevation.

The adjustable handle construction of the invention provides a more comfortable operation which can be adjusted to suit the stature of the operator and the environment of use, and has particular advantage when the compactor is operating at a lower elevation or in a trench.

As the handle can be positioned in a more comfortable location, the operator has better control of the compaction operation.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the percussion rammer incorporating the adjustable handle construction of the invention;

FIG. 2 is a top elevation of the handle construction; and

FIG. 3 is a side elevation of the handle construction.

DESCRIPTION OF THE ILLUSTRATED EMBODIMENT

FIG. 1 illustrates a soil compactor and more particularly a percussion rammer 1. The percussion rammer 1 itself is of conventional construction and includes a vertical drive cylinder 2 and a piston rod, not shown, extends from the lower end of the cylinder and is connected to a shoe 3 that is adapted to engage the soil or other surface to be compacted. An expandable resilient bellows 4 is interconnected between the lower end of cylinder 2 and the upper end of the shoe and houses the piston rod.

A gasoline engine 5 is located on the upper end of the percussion rammer and the drive shaft of the engine operates through a gear box or transmission 6 to drive the piston in a reciprocating path. In practice, the shoe may operate with a speed of about 600 strokes per minute with a 2 to 3 inch reciprocating stroke.

A fuel tank 7 and air cleaner 8 for engine 5 are also mounted on the upper end of the percussion rammer.

A tubular metal guard 9, which is generally rectangular in horizontal elevation, surrounds the engine 5, fuel tank 7 and air cleaner 8, and opposed portions of the guard are welded to the upper ends of vertical bracket 10 which are connected to opposite sides of transmission 6 through resilient shock mounts 11. Guard 9 serves to protect the engine, as well as other engine components, in the event the rammer should topple over during use, or when the rammer is laid on the ground at rest.

As best shown in FIGS. 2 and 3, guard 9 includes a generally rectangular section 12 and the end of section 12, which is connected to brackets 10, is inclined downwardly as indicated by 13. A tubular brace 14 interconnects each bracket 10 with the respective side of the rectangular section 12. In addition, a pair of arches 15 extend transversely across the rectangular section 12 to reinforce the same and protect the fuel tank 7. The fuel tank 7 is mounted on the guard 9 through mounting brackets 16 which extend inwardly from each side of the rectangular section 12 of the guard.

A tubular handle 17 is pivotally connected to guard 9. Handle 17 includes a pair of parallel arms 18, the ends of which are connected by a cross member 19. A section of metal bar stock 20 has an inner end of reduced diameter which is secured within the end of each arm 18 and as illustrated in the drawings, the outer portion of bar stock 20 has a hexagonal cross section. The end of each section of bar stock 20 is pivotally connected to a pair of parallel brackets 21 about a pivot 22. Brackets 21 are welded to the respective sides of the section 12 of guard 9.

To lock handle 17 in position relative to guard 9, a hole 23 is provided in each bar section 20 and is adapted to register with one of a plurality of holes 24 formed in the brackets 21. By inserting a bolt 25, or other fastener, through the aligned holes 23 and 24, the handle can be locked in various elevations relative to guard 9. As shown in FIG. 3, when the handle is connected by bolt 25 to the lowermost of the holes 24, the inner portion of the handle will be inclined downwardly from the horizontal, while the distal portion 26 of the handle, which projects rearwardly beyond guard 9, will be located at a further downwardly inclined angle. The distal end 26 is then in a position which corresponds to a standard handle position.

In the event the percussion rammer is to be used in a trench or at a lower elevation, the handle 17 can be pivoted upwardly, after removal bolt 25, and locked at a higher elevation by insertion of the bolt through one of the upper holes 24 in brackets 21. With the handle locked in its uppermost position, the distal end 26 of handle 17 will be located approximately 18 inches above the position of the distal end when the handle is in its lowermost elevation.

The construction of the invention enables the handle to be positioned at various elevations to suit the stature of the operator, or the location of use of the rammer and has particular advantage when the rammer is operated in a trench or at a lower elevation.

As the handle 17 can be maintained at a comfortable location regardless of the elevation of the surface being compacted, the operator has better control of the compacting operation.

Various modes of carrying out the invention are contemplated as being within the scope of the following claims particularly pointing out and distinctly claiming the subject matter which is regarded as the invention.

I claim:

1. In a compaction apparatus, a soil compacting member, drive means operably connected to said soil compacting member for driving said soil compacting member in a vertical reciprocating path to compact said soil, guard means spaced and surrounding said drive means, a handle having an inner end and having an opposed distal end projecting outwardly beyond said guard means and positioned to be engaged by an operator, means for pivotally connecting the inner end of the handle to said guard means such that said distal end is movable between a position below the guard means to a position above the guard means, and adjustable locking means interconnecting the handle at a location between said ends to said guard means for locking the handle to said guard means at a plurality of different elevations between said above and below positions, said guard means being generally rectangular in horizontal elevation and including a pair of parallel spaced side members, said handle being generally U-shaped and having a pair of generally parallel arms, said guard means including a forward end portion and a rear end portion disposed at a downwardly inclinded angle with respect to said forward portion, said arms being pivotally connected to the rear end portions of said side members.

2. The apparatus of claim 1, wherein said drive means includes a gasoline engine and said guard means is spaced outwardly of said engine.

3. The apparatus of claim 1, wherein the distal end of said handle is disposed at a downwardly inclined angle with respect to said inner end.

* * * * *